US006337610B1

(12) United States Patent
Williams et al.

(10) Patent No.: US 6,337,610 B1
(45) Date of Patent: Jan. 8, 2002

(54) ASYMMETRIC RESPONSE BANDPASS FILTER HAVING RESONATORS WITH MINIMUM COUPLINGS

(75) Inventors: Albert Edward Williams, Bethesda; John Irving Upshur; Mohammed Mahbubur Rahman, both of Germantown, all of MD (US)

(73) Assignee: Comsat Corporation, Bethesda, MD (US)

( * ) Notice: Subject to any disclaimer, the term of this patent is extended or adjusted under 35 U.S.C. 154(b) by 0 days.

(21) Appl. No.: 09/444,308

(22) Filed: Nov. 22, 1999

(51) Int. Cl.[7] ..... H01P 1/208
(52) U.S. Cl. ..... 333/202; 333/208; 333/212
(58) Field of Search ..... 333/202, 203, 333/208, 209, 212, 227, 230

(56) References Cited

U.S. PATENT DOCUMENTS

| | | | | |
|---|---|---|---|---|
| 4,167,713 A | | 9/1979 | Pfitzenmaier | 333/212 |
| 4,246,555 A | * | 1/1981 | Williams | 333/212 X |
| 4,477,785 A | | 10/1984 | Atia | 333/202 |
| 4,544,901 A | * | 10/1985 | Rhodes et al. | 333/208 X |
| 4,721,933 A | * | 1/1988 | Schwartz et al. | 333/212 |
| 4,772,863 A | | 9/1988 | Rosenberg et al. | 333/212 |
| 4,881,051 A | | 11/1989 | Tang et al. | 333/208 |
| 5,097,236 A | | 3/1992 | Wakino et al. | 333/175 |
| 5,410,284 A | | 4/1995 | Jachowski | 333/202 |
| 5,608,363 A | | 3/1997 | Cameron et al. | 333/202 |
| 5,699,029 A | * | 12/1997 | Young et al. | 333/212 |
| 5,760,667 A | | 6/1998 | Young et al. | 333/212 |
| 5,936,490 A | * | 8/1999 | Hershtig | 333/202 |

FOREIGN PATENT DOCUMENTS

| | | | | |
|---|---|---|---|---|
| DE | 2056528 B2 | * | 9/1978 | 333/212 |
| GB | 2 269 704 | | 2/1994 | |

OTHER PUBLICATIONS

Richard M. Kurzrok; "General Three–Resonator Filters in Waveguide," *IEEE Transactions on Microwave Theory and Techniques*; Jan., 1966, pp. 46–47.*

Hui–Wen Yao et al.; "Generalized Slot Coupled Combine Filters", *1995 IEEE MTTS–S Digest*; May, 1995, vol. 2, pp 395–398, May, 1995.*

Ji–Fuh Liang et al.; "General Coupled Resonator Filters Design Based on Canonical Asymmetric Building Blocks", *1999 IEEE MTT–S Digest, Microwave Symposium Digest*; Jun., 1999, vol. 3, pp. 907–910, Jun., 1999.

* cited by examiner

*Primary Examiner*—Robert Pascal
*Assistant Examiner*—Barbara Summons
(74) *Attorney, Agent, or Firm*—Sughrue Mion, PLLC

(57) ABSTRACT

Asynchronously-tuned coupled resonator cavities are implemented having a minimum set of inter-resonator couplings, wherein the filter design incorporates only series and parallel couplings. By way of example, $8^{th}$ order filter topologies having three transmission zeros, no cross-couplings, and only eight series and/or parallel couplings can be achieved.

15 Claims, 4 Drawing Sheets

ASYMMETRIC RESPONSE BANDPASS FILTER HAVING RESONATORS WITH MINIMUM COUPLINGS

BACKGROUND OF THE INVENTION

1. Field of the Invention

The invention relates generally to asymmetric response bandpass filters implemented with a plurality of coupled resonators. More specifically, the present invention relates to asymmetric response bandpass filters configured to require only series and shunt couplings between the plurality of resonators.

2. Description of the Related Art

Filters are generally used in communication systems to selectively separate and isolate a specific signal or frequency bandwidth from a reception having a plurality of received signals and frequencies. For example, a bandpass filter freely passes frequencies within specified range, while rejecting frequencies outside the specified limits, and can be designed to provide symmetric or asymmetric characteristics.

A filter has symmetric characteristics when transmission zeros are symmetrically disposed about a center frequency of a filter's usable bandwidth. In contrast, a filter has asymmetric characteristics when transmission zeros are placed asymmetrically about the filter's passband. The later is useful for satisfying desired out-of-band amplitude and/or in-band group delay asymmetric specifications.

The theory describing the realization of asymmetrical response bandpass filters implemented with coupled cavities was developed by Cameron and Rhodes in the early 1980s. Their theories are described in detail in "Fast Generation of Chebychev Filter Prototypes with Asymmetrically-Prescribed Transmission Zeros," ESA Journal 1982, Vol. 6, No. 1, page 83, and "General Prototype Network Synthesis Methods for Microwave Filters," ESA Journal 1982, Vol. 6, No. 2, page 193, both of which are hereby incorporated by reference in their entirety.

It is well-known that a general solution for a low pass filter transfer function for n-coupled resonators is expressed as follows:

$$T(s)=[\hat{s}(n-2) \text{ order polynomial}]/[\hat{s}(n) \text{ order polynomial}]$$

where s represents the complex frequency.

Using the above equation, it becomes evident that a filter of order n requires n-coupled resonators to provide less than or equal to (n−2) transmission zeros. A transmission zero is defined when T(s)=0 or when the numerator of the polynomial becomes zero. Therefore, a $4^{th}$ order filter would have a maximum of 2 transmission zeros; a $6^{th}$ order would have 4; an $8^{th}$ order would have 6, a $10^{th}$ order would have 8; and so on.

A transmission zero is important in the field of communication systems because it provides an insertion loss at a specified frequency, thereby enabling the detection of a specific region from a signal having a wide frequency range. The transmission zero ensures sharp amplitude selectivity and a rejection of adjacent signals on the high and/or low side of the amplitude frequency response.

FIG. 1 shows a prior art nth order coupled resonator filter used to implement the above transfer function. Each of the blocks represents a resonator cavity and the lines connecting the resonator cavities represent couplings. The filter of FIG. 1 is a folded structure having two rows of resonator cavities, wherein the first row includes resonator cavities 1 through n, and the second row includes resonator cavities (n+1) through 2n. The folded structure is such that resonator cavity 1 is adjacent to resonator cavity 2n, resonator cavity 2 is adjacent to resonator cavity (2n−1), . . . and resonator cavity n is adjacent to resonator cavity (n+1). Resonant cavities 1, 2 . . . n and resonant cavities (n+1) . . . 2n are coupled in succession, respectively, through series couplings that provide a first degree of freedom for controlling the shape of the filter's frequency response over its passband. A plurality of shunt couplings couple adjacent resonant cavities, such as resonant cavities 1 and 2n and resonant cavities n and (n+1), providing second and third degrees of freedom for controlling the sharpness of the frequency response's transition between its passband and stopband, and further control the linearity of the filter's phase. The couplings between non-sequential resonator cavities, such as between resonator cavities 1 and (2n−1) and resonator cavities 2 and (2n−2), are referred to as diagonal cross-couplings and they also providing second and third degrees of freedom for controlling the sharpness of the frequency response's transition between its passband and stopband, and further control the linearity of the filter's phase. It should be noted that to implement the described filter in FIG. 1, three and four inter-cavity couplings are required per resonator cavity.

FIG. 2 shows a filter design derived from the general filter response function given above, having an eighth order geometry and three transmission zeros. As shown, several resonator cavities require three or more inter-cavity couplings. FIG. 3 shows the electrical transmission characteristic of the filter of FIG. 2, wherein the three transmission zeros at located at approximately 890, 891, and 922 MHz and the center frequency is located at approximately 895 MHz.

As will be appreciated by those skilled in the art, it is difficult to physically place several couplings into a single resonator cavity, and is especially difficult to place cross-couplings into a resonator cavity. A complicated structure also makes the manufacture of such a filter costly. This is especially true when the resonators are planar, such as those that may be used in the design of a superconducting coupled resonator filter.

SUMMARY OF THE INVENTION

It is therefore an object of the present invention to provide an asymmetric response bandpass filter having a minimum number of couplings per resonator cavity.

It is yet another object of the invention to provide an asymmetric response bandpass filter where complicated cross couplings are eliminated.

The foregoing and other objects are accomplished by implementing asynchronously-tuned coupled resonator cavities having a minimum number of inter-resonator couplings, wherein the filter design contains only series and parallel couplings.

According to a first embodiment of the present invention, an asymmetrical response bandpass filter is provided, having a first plurality of series coupled resonator cavities defining a first row, a second plurality of series coupled resonator cavities defining a second row, an input terminal in communication with a preselected input resonator cavity of the first row, an output terminal in communication with a preselected output resonator cavity of the second row, and at least one parallel coupling between said first row and said second row, wherein said first plurality of series coupled resonator cavities of said first row and said second plurality of series coupled resonator cavities of second row are arranged in a predetermined order to eliminate diagonal cross-couplings.

According to second embodiment of the present invention, an asymmetrical response bandpass filter is provided, having a first row of four series coupled resonator cavities, wherein a first resonator cavity is coupled to a second resonator cavity, said second resonator cavity is coupled to a third resonator cavity, and said third resonator cavity is coupled to a fourth resonator cavity, a second row of four series coupled resonator cavities, wherein a fifth resonator cavity is coupled to a sixth resonator cavity, said sixth resonator cavity is coupled to a seventh resonator cavity, and said seventh resonator cavity is coupled to an eighth resonator cavity, an input terminal in communication with said first resonator cavity of the first row, an output terminal in communication with said eighth resonator cavity of the second row, and parallel couplings which connect said first and seventh resonator cavities and said eighth and second resonator cavities, respectively.

According to a third embodiment of the present invention, an asymmetrical response bandpass filter is provided, having a first row of four series coupled resonator cavities, wherein a fifth resonator cavity is coupled to a first resonator cavity, said first resonator cavity is coupled to a second resonator cavity, and said second resonator cavity is coupled to a third resonator cavity, a second row of four series coupled resonator cavities, wherein a fourth resonator cavity is coupled to an eighth resonator cavity, said eighth resonator cavity is coupled to a seventh resonator cavity, and said seventh resonator cavity is coupled to a sixth resonator cavity, an input terminal in communication with said first resonator cavity of the first row, an output terminal in communication with said eighth resonator cavity of the second row, and parallel couplings which connect said fifth and sixth resonator cavities, said first and seventh resonator cavities, said second and eighth resonator cavities and said third and fourth resonator cavities, respectively.

According to a fourth embodiment of the present invention, an asymmetrical response bandpass filter is provided, having a first row of four series coupled resonator cavities, wherein an eighth resonator cavity is coupled to a seventh resonator cavity, said seventh resonator cavity is coupled to a sixth resonator cavity, and said sixth resonator cavity is coupled to a fifth resonator cavity, a second row of four series coupled resonator cavities, wherein a fourth resonator cavity is coupled to a third resonator cavity, said third resonator cavity is coupled to a second resonator cavity, and said second resonator cavity is coupled to a first resonator cavity, an input terminal in communication with said first resonator cavity of the first row, an output terminal in communication with said eighth resonator cavity of the second row, and parallel couplings which connect said eighth and fourth resonator cavities, said seventh and third resonator cavities, said sixth and second resonator cavities and said fifth and first resonator cavities, respectively.

BRIEF DESCRIPTION OF THE DRAWINGS

The foregoing and other features, objects, and advantages of the invention will be better understood by reading the following description in conjunction with the drawings, in which.

DETAILED DESCRIPTION OF THE INVENTION

Figure 1:
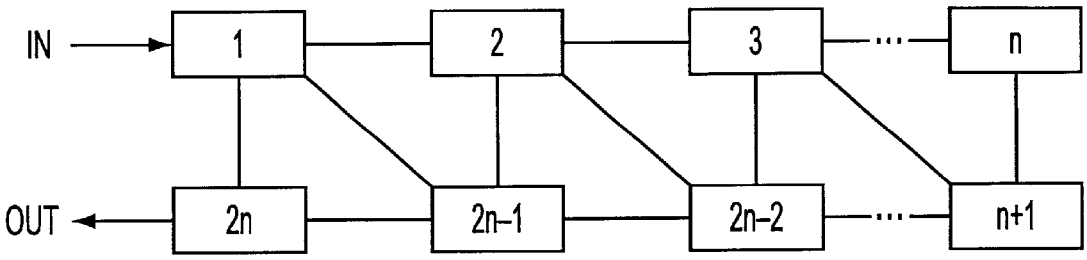
FIG. 1 PRIOR ART
FIG. 1 shows an nth- order filter known in the prior art.
Figure 2:
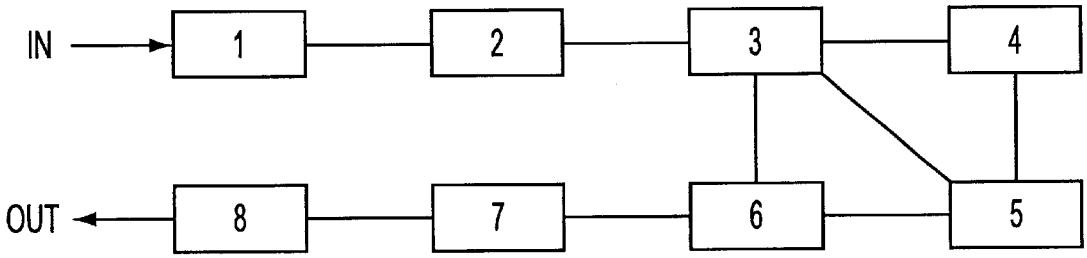
FIG. 2 PRIOR ART
FIG. 2 shows an eighth order filter with three transmission zeros known in the prior art.

The various features of the present invention will now be described with respect to the figures, in which like parts are identified with the same reference characters.

Figure 4A:
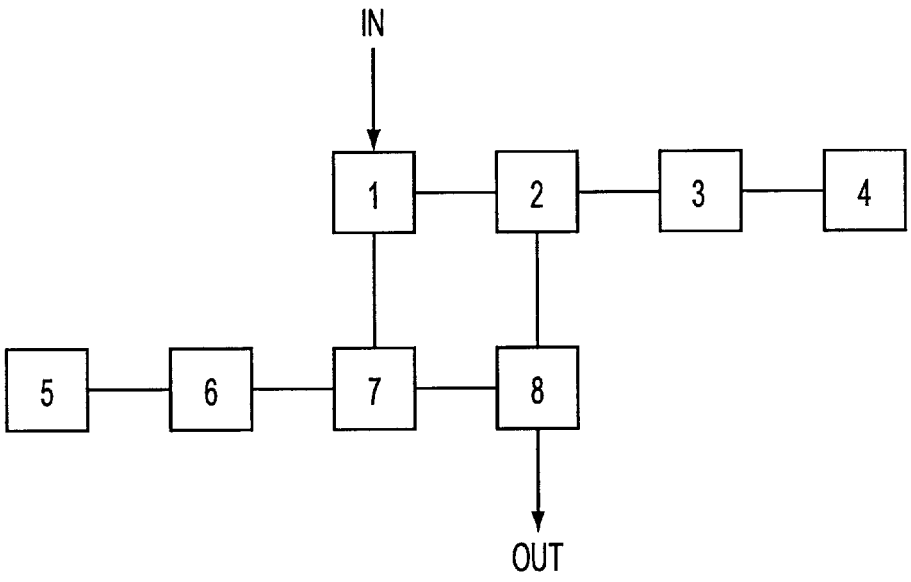
FIGS. 4A—C show filter topologies according to exemplary embodiments of the invention.
Figure 4B:
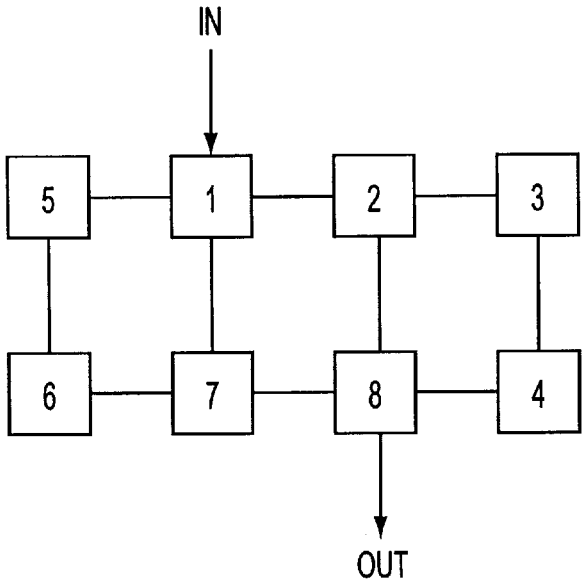
Figure 4C:
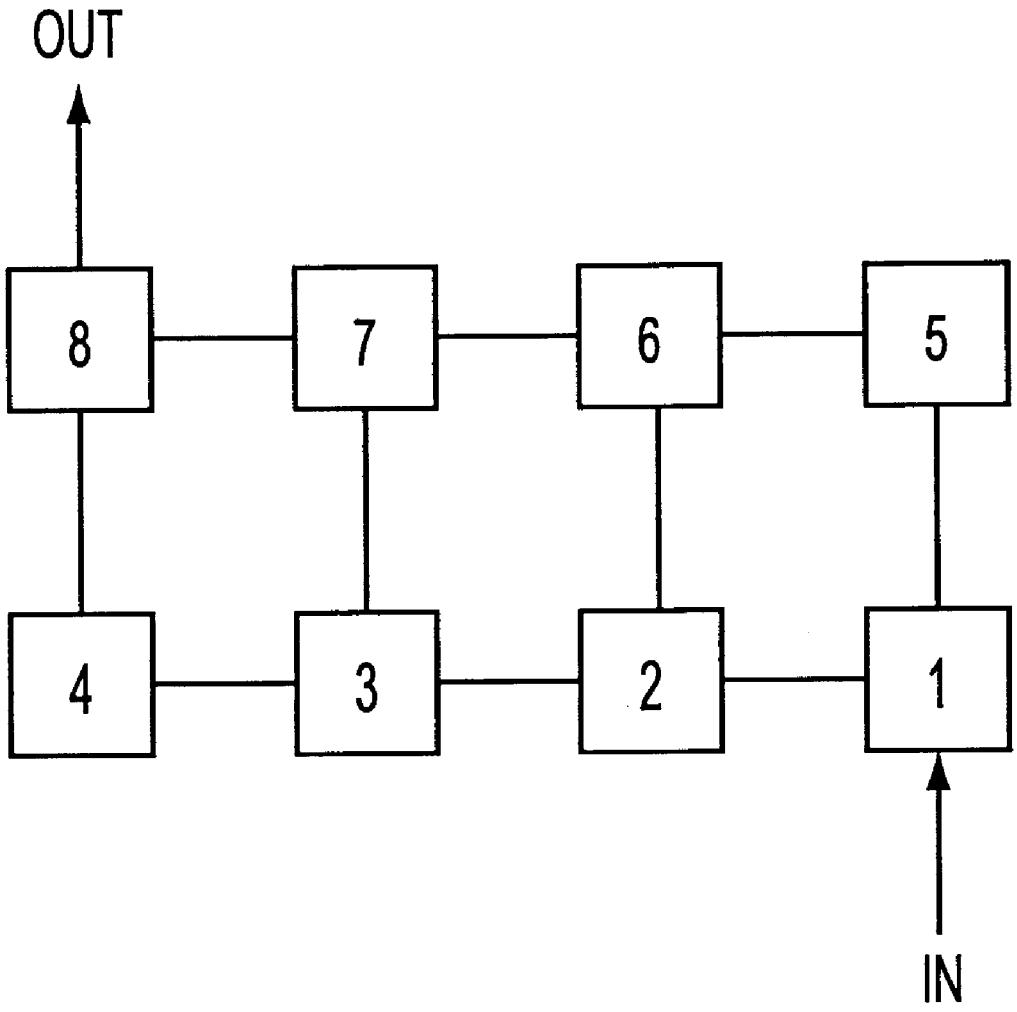

FIGS. 4A–C show three embodiments of nth order asynchronously tuned coupled resonator cavities where n=8. The $8^{th}$ order filters in FIGS. 4A–C have three transmission zeros and a minimum number of series and parallel inter-resonator couplings for connecting the several resonator cavities.

FIG. 4A shows a first embodiment of an $8^{th}$ order topology. Eight resonator cavities are provided in blocks labeled 1–8. A first row of resonator cavities 1–4 is series coupled, wherein resonator cavity 1 is on the far left and resonator cavity 4 is on the far right. Specifically, the $1^{st}$ resonator cavity is coupled to the $2^{nd}$ resonator cavity, the $2^{nd}$ resonator cavity is coupled to the $3^{rd}$ resonator cavity, and the $3^{rd}$ resonator cavity is coupled to the $4^{th}$ resonator cavity.

A second row of resonator cavities 5–8 is series coupled, wherein resonator cavity 5 is on the far left and resonator cavity 8 is on the far right. Specifically, the $5^{th}$ resonator cavity is coupled to the $6^{th}$ resonator cavity, the $6^{th}$ resonator cavity is coupled to the $7^{th}$ resonator cavity, and the $7^{th}$ resonator cavity is coupled to the $8^{th}$ resonator cavity. Further, resonator cavities 1 and 7 and resonator cavities 2 and 8, respectively, are shunt connected. An input terminal is connected to resonating cavity 1 and an output terminal is connected to resonating cavity 8.

FIG. 4B shows a second embodiment of an $8^{th}$ order topology. Eight resonator cavities are provided in blocks labeled 1–8. A first row of resonator cavities 5 and 1–3 is series coupled, wherein resonator cavity 5 is on the far left and resonator cavity 3 is on the far right. Specifically, the $5^{th}$ resonator cavity is coupled to the $1^{st}$ resonator cavity, the $1^{st}$ resonator cavity is coupled to the $2^{nd}$ resonator cavity, and the $2^{nd}$ resonator cavity is coupled to the $3^{rd}$ resonator cavity.

A second row of resonator cavities 6–8 and 4 is series coupled, wherein resonator cavity 6 is on the far left and resonator cavity 4 is on the far right. Specifically, the $6^{th}$ resonator cavity is coupled to the $7^{th}$ resonator cavity, the $7^{th}$ resonator cavity is coupled to the $8^{th}$ resonator cavity, and the $8^{th}$ resonator cavity is coupled to the $4^{th}$ resonator cavity. Further, resonator cavities 5 and 6, resonator cavities 1 and 7, resonator cavities 2 and 8, and resonator cavities 3 and 4, respectively, are shunt connected. An input terminal is connected to resonating cavity 1 and an output terminal is connected to resonating cavity 8.

FIG. 4C shows a third embodiment of an $8^{th}$ order topology. Eight resonator cavities are provided in blocks labeled 1–8. A first row of resonator cavities 5–8 is series coupled, wherein resonator cavity 8 is on the far left and resonator cavity 5 is on the far right. Specifically, the $8^{th}$ resonator cavity is coupled to the $7^{th}$ resonator cavity, the $7^{th}$ resonator cavity is coupled to the $6^{th}$ resonator cavity, and the $6^{th}$ resonator cavity is coupled to the $5^{th}$ resonator cavity.

A second row of resonator cavities 1–4 is series coupled, wherein resonator cavity 4 is on the far left and resonator cavity 1 is on the far right. Specifically, the $4^{th}$ resonator cavity is coupled to the $3^{rd}$ resonator cavity, the $3^{rd}$ resonator cavity is coupled to the $2^{nd}$ resonator cavity, and the $2^{nd}$ resonator cavity is coupled to the $1^{st}$ resonator cavity. Further, resonator cavities 4 and 8, resonator cavities 3 and 7, resonator cavities 2 and 6, and resonator cavities 1 and 5, respectively, are shunt connected. An input terminal is connected to resonating cavity 1 and an output terminal is connected to resonating cavity 8.

Figure 3:
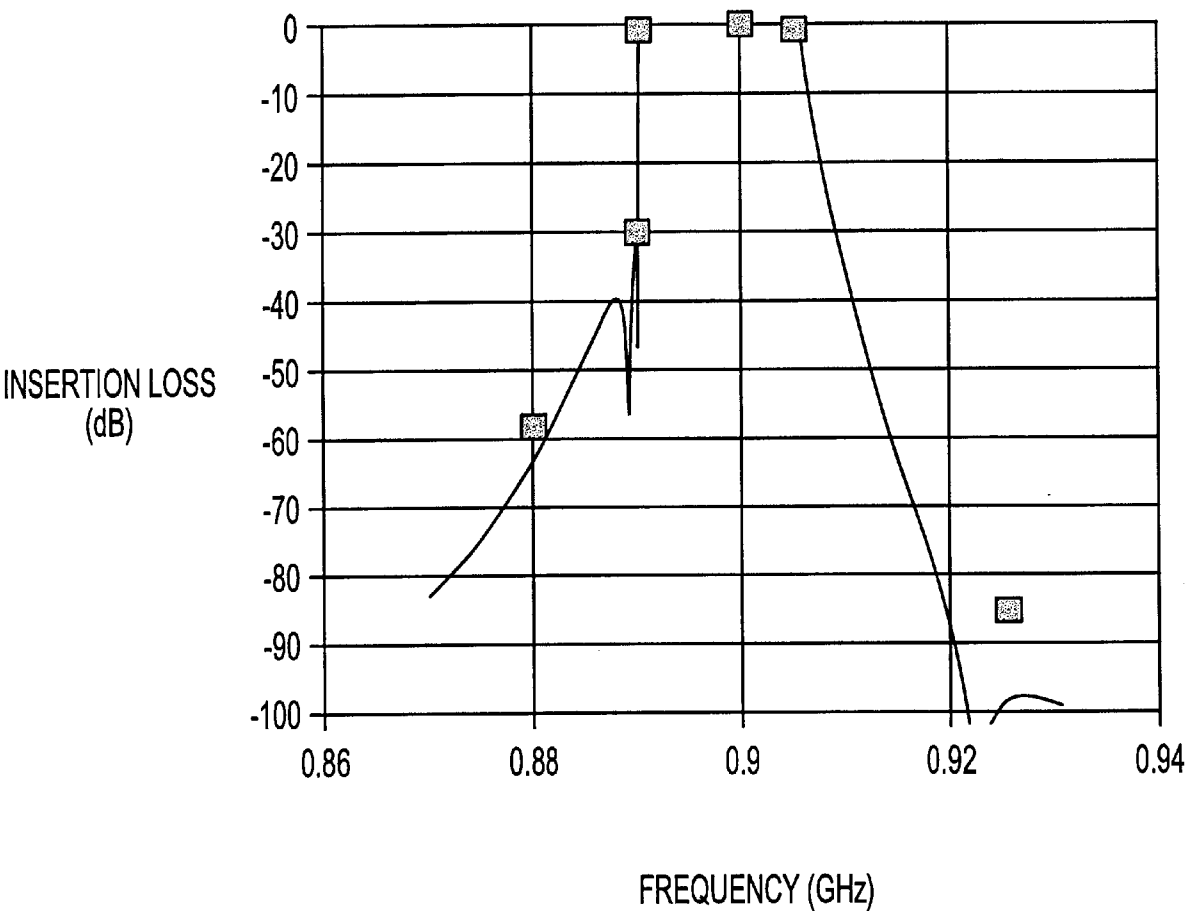
FIG. 3 PRIOR ART
FIG. 3 illustrates a computed response of the eighth order filter with three transmission zeros, as shown in FIG. 2.

According to the above embodiments shown in FIGS. 4A–C, all complex cross couplings have been eliminated for the $8^{th}$ order resonators having three transmission zeros. Each of the filters shown in FIGS. 4A–C is able to produce the asymmetrical frequency response shown in FIG. 3. The configurations shown in FIGS. 4A–C are physically easier to implement than the configurations of the prior art.

The present invention has been described by way of example, and modifications and variations of the exemplary embodiments will suggest themselves to skilled artisans in this field, without departing from the spirit of the invention. The preferred embodiments are merely illustrative and should not be considered restrictive in any way. The scope of the invention is to be measured by the appended claims, rather than the preceding description, and all variations and equivalents that fall within the range of the claims are intended to be embraced therein.

What is claimed is:

1. An asymmetrical response bandpass filter, comprising:

a first row of four series coupled resonator cavities, wherein a first resonator cavity is coupled to a second resonator cavity, said second resonator cavity is coupled to a third resonator cavity, and said third resonator cavity is coupled to a fourth resonator cavity;

a second row of four series coupled resonator cavities, wherein a fifth resonator cavity is coupled to a sixth resonator cavity, said sixth resonator cavity is coupled to a seventh resonator cavity, and said seventh resonator cavity is coupled to an eighth resonator cavity;

an input terminal in communication with said first resonator cavity of the first row;

an output terminal in communication with said eighth resonator cavity of the second row; and parallel couplings which connect said first and seventh resonator cavities and said eighth and second resonator cavities, respectively.

2. The asymmetrical response bandpass filter according to claim 1, wherein each of said first, second, seventh and eighth resonator cavities supports only one parallel coupling.

3. The asymmetrical response bandpass filter according to claim 1, having a filter response containing three transmission zeros in.

4. The asymmetrical response bandpass filter according to claim 1, wherein each resonator cavity supports at most three couplings.

5. The asymmetrical response bandpass filter according to claim 1, which solves a specified transfer function.

6. An asymmetrical response bandpass filter, comprising:

a first row of four series coupled resonator cavities, wherein a fifth resonator cavity is coupled to a first resonator cavity, said first resonator cavity is coupled to a second resonator cavity, and said second resonator cavity is coupled to a third resonator cavity;

a second row of four series coupled resonator cavities, wherein a fourth resonator cavity is coupled to an eighth resonator cavity, said eighth resonator cavity is coupled to a seventh resonator cavity, and said seventh resonator cavity is coupled to a sixth resonator cavity;

an input terminal in communication with said first resonator cavity of the first row;

an output terminal in communication with said eighth resonator cavity of the second row; and parallel couplings which connect said fifth and sixth resonator cavities, said first and seventh resonator cavities, said second and eighth resonator cavities and said third and fourth resonator cavities, respectively.

7. The asymmetrical response bandpass filter according to claim 6, wherein each of said first, second, third, fourth, fifth, sixth, seventh and eighth resonator cavities supports only one parallel coupling.

8. The asymmetrical response bandpass filter according to claim 6, having a filter response containing three transmission zeros.

9. The asymmetrical response bandpass filter according to claims 6, wherein each resonator cavity supports at most three couplings.

10. The asymmetrical response bandpass filter according to claim 6 which solves a specified transfer function.

11. An asymmetrical response bandpass filter, comprising:

a first row of four series coupled resonator cavities, wherein an eighth resonator cavity is coupled to a seventh resonator cavity, said seventh resonator cavity is coupled to a sixth resonator cavity, and said sixth resonator cavity is coupled to a fifth resonator cavity;

a second row of four series coupled resonator cavities, wherein a fourth resonator cavity is coupled to a third resonator cavity, said third resonator cavity is coupled to a second resonator cavity, and said second resonator cavity is coupled to a first resonator cavity;

an input terminal in communication with said first resonator cavity of the first row;

an output terminal in communication with said eighth resonator cavity of the second row; and parallel couplings which connect said eighth and fourth resonator cavities, said seventh and third resonator cavities, said sixth and second resonator cavities and said fifth and first resonator cavities, respectively.

12. The asymmetrical response bandpass filter according to claim 11, wherein each of said first, second, third, fourth, fifth, sixth, seventh and eighth resonator cavities supports only one parallel coupling.

13. The asymmetrical response bandpass filter according to claim 11, having a filter response containing three transmission zeros.

14. The asymmetrical response bandpass filter according to claim 11, wherein each resonator cavity supports at most three couplings.

15. The asymmetrical response bandpass filter according to claim 11, which solves a specified transfer function.

* * * * *